US009508466B2

(12) United States Patent
Kondo

(10) Patent No.: US 9,508,466 B2
(45) Date of Patent: Nov. 29, 2016

(54) HIGH-FREQUENCY ELECTRIC WIRE, MANUFACTURING METHOD THEREOF, AND WIRE HARNESS

(71) Applicant: Yazaki Corporation, Minato-ku, Tokyo (JP)

(72) Inventor: Hiroki Kondo, Susono (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/996,698

(22) Filed: Jan. 15, 2016

(65) Prior Publication Data

US 2016/0133356 A1 May 12, 2016

Related U.S. Application Data

(63) Continuation of application No. PCT/JP2014/069347, filed on Jul. 22, 2014.

(30) Foreign Application Priority Data

Jul. 22, 2013 (JP) ..... 2013-151247

(51) Int. Cl.

| | |
|---|---|
| ***H01B 7/00*** | (2006.01) |
| ***H01B 3/30*** | (2006.01) |
| ***H01B 7/30*** | (2006.01) |
| ***H01B 13/00*** | (2006.01) |

(52) U.S. Cl.

CPC ..... *H01B 7/303* (2013.01); *H01B 7/0045* (2013.01); *H01B 13/0006* (2013.01)

(58) Field of Classification Search

CPC . H01B 7/303; H01B 13/0006; H01B 7/0045

USPC ..... 174/72 A, 110 R, 110 SR, 113 R; 29/825

See application file for complete search history.

(56) References Cited

U.S. PATENT DOCUMENTS 4,969,260 A * 11/1990 Kondo ..... H01R 4/20 29/863

5,149,917 A * 9/1992 Sawada ..... B60R 16/0215 174/110 R (Continued)

FOREIGN PATENT DOCUMENTS

CN 200956284 Y 10/2007

CN 102097169 A 6/2011

(Continued)

OTHER PUBLICATIONS

Feb. 4, 2016—(WO) Eng Tran of IPRP and Written Opinion of the ISA—App PCT/JP2014/069347.

(Continued)

*Primary Examiner* — Sherman Ng

(74) *Attorney, Agent, or Firm* — Banner & Witcoff, Ltd.

(57) ABSTRACT

A high-frequency electric wire is provided with a conductor which formed by compressing multiple wire strands, each of which is obtained by coating an outside of a wire rod made of insulating resin with a metal layer, and a sheath provided on the conductor. Each of the wire strands of the conductor is compressed in such a way that a deformation ratio of the wire strand exceeds 0% and is 20% or less. The compression is performed, for example, during bundling and sheathing of the multiple wire strands.

3 Claims, 4 Drawing Sheets

(56) References Cited

U.S. PATENT DOCUMENTS

| | | | | |
|---|---|---|---|---|
| 8,299,654 | B2 | 10/2012 | Yamamoto et al. | |
| 2010/0300725 | A1* | 12/2010 | Nakayama | H01B 13/142 174/110 SR |
| 2011/0036614 | A1* | 2/2011 | Otsuka | C22C 21/00 174/113 R |
| 2011/0140539 | A1 | 6/2011 | Yamamoto et al. | |
| 2014/0008097 | A1* | 1/2014 | Sugie | H01B 7/303 174/102 R |
| 2014/0069686 | A1* | 3/2014 | Abe | H01B 7/02 174/110 SR |
| 2014/0080933 | A1* | 3/2014 | Abe | C08L 23/08 521/79 |

FOREIGN PATENT DOCUMENTS

| | | | |
|---|---|---|---|
| GB | 2007120 | A | 5/1979 |
| JP | H03-103511 | U | 10/1991 |
| JP | 2011-124129 | A | 6/2011 |
| JP | 2012-022989 | A | 2/2012 |

OTHER PUBLICATIONS

Oct. 21, 2014—International Search Report—Intl App PCT/JP2014/069347.

Aug. 19, 2016—(CN) Notification of the First Office Action—App 201480041653.2.

* cited by examiner

WIRE STRAND
BEFORE DEFORMATION

WIRE STRAND
AFTER DEFORMATION

HIGH-FREQUENCY ELECTRIC WIRE, MANUFACTURING METHOD THEREOF, AND WIRE HARNESS

CROSS-REFERENCES TO RELATED APPLICATION

This application is a continuation of International Patent Application No. PCT/JP2014/069347 filed on Jul. 22, 2014, claiming priority from Japanese Patent Application No. 2013-151247 filed on Jul. 22, 2013, the contents of which are incorporated herein by reference.

BACKGROUND

1. Field of the Invention

The present invention relates to a high-frequency electric wire, a manufacturing method thereof, and a wire harness.

2. Description of Related Art

In the related art, a litz wire used to transmit high-frequency signals is known. The litz wire includes a conductor obtained by twisting together multiple wire strands, each of which is obtained by coating a metal conductor with an insulating layer. Typically, high-frequency signals are known to flow only through a vicinity of a surface of a conductor due to a skin effect during transmission of the high-frequency signals. Since the litz wire includes the conductor formed of the multiple wire strands, high-frequency signals flow through the surface of the metal conductor of each of the wire strands. As a result, it is possible to suppress an increase in high frequency resistance due to the skin effect.

In such a litz wire, for example, a minimum diameter of the wire strand is approximately 50 μm. When a depth of the skin during transmission of high-frequency signals is less than 50 μm, a center side of the metal conductor becomes a waste metal portion through which current does not flow except for a surface side of the metal conductor.

A high-frequency electric wire, in which a metal-pipe wire rod with a shape of a circular cylinder is used instead of the wire strand, has been proposed. Since the metal-pipe wire rod is used in this electric wire, a portion corresponding to the waste portion is hollow, and thus it is possible to reduce the costs of the wire rod (refer to Patent Document 1: JP-A-2011-124129).

Patent Document 1: JP-A-2011-124129

However, since the metal-pipe wire rod is used in the high-frequency electric wire disclosed in Patent Document 1, it becomes difficult to reduce a diameter of the high-frequency electric wire. That is, in the metal-pipe wire rod, a metal portion with a thickness of approximately 10 μm is required to be formed on the outside of a hollow portion with a diameter of 50 μm so as to transmit high-frequency signals equivalent to a wire strand with a diameter of 50 μm. Accordingly, the diameter of the metal-pipe wire rod becomes 70 μm, leading to a hindrance to the reduction in the diameter of a high-frequency electric wire.

Since each of the wire strands or the metal-pipe wire rods has a circular outer circumference, gaps therebetween are formed, even after twisting. When wear properties of a sheath material are taken into consideration, a finished outer diameter of the high-frequency electric wire is limited.

When the conductor obtained by twisting together the wire strands is used, as a countermeasure for such a problem, the gaps are eliminated, and the diameter of the high-frequency electric wire is reduced by compressing the conductor formed of the multiple wire strands. However, when the metal-pipe wire rod is used, the hollow portion is blocked by compression, and thus a similar countermeasure cannot be adopted.

As such, in the related art, it is difficult to reduce the outer diameter of the electric wire while preventing an increase in high frequency resistance caused by the skin effect, and while reducing costs.

SUMMARY

One or more embodiments provide a high-frequency electric wire, a manufacturing method thereof, and a wire harness in which it is possible to reduce an outer diameter of the electric wire while preventing an increase in high frequency resistance caused by a skin effect, and while reducing costs.

(1) In accordance with one or more embodiments, a high-frequency electric wire includes a conductor obtained by compressing multiple wire strands, each of which includes a wire rod made of insulating resin and a metal layer with which the outer circumference of the wire rod is coated, and a sheath provided on the conductor. Each of the wire strands of the conductor is compressed in such a way that the deformation ratio of the wire strand exceeds 0% and is 20% or less.

(2) In accordance with one or more embodiments, a method of manufacturing a high-frequency electric wire includes a first step of obtaining a wire strand by coating the outer circumference of a wire rod made of insulating resin with a metal layer, and a second step of compressing multiple wire strands obtained in the first step by bundling and sheathing. In the second step, each of the wire strands is compressed in such a way that the deformation ratio of the wire strand exceeds 0% and is 20% or less.

(3) In accordance with one or more embodiments, a wire harness uses the high-frequency electric wire described in the above [1].

In the high-frequency electric wire and the wire harness of the embodiments, since the conductor is formed of the multiple wire strands, high-frequency signals are transmitted through the surface side of each of the wire strands, and thus it is possible to suppress an increase in high frequency resistance caused by the skin effect. Since the wire strand obtained by coating the outer circumference of the wire rod (which is made of insulating resin) with the metal layer is used, a waste portion through which current does not flow during transmission of high-frequency signals can be made of resin, and thus it is possible to reduce the costs of the wire rod. Since such the wire strand is used, it is possible to compress the conductor formed of the multiple wire strands, and to reduce the outer diameter of the electric wire. As a result, it is possible to reduce the outer diameter of the electric wire while preventing an increase in high frequency resistance caused by the skin effect, and while reducing costs.

Each of the wire strands of the conductor is compressed in such a way that the compression ratio of the wire strand exceeds 0% and is 20% or less. The reason for this is that when the deformation ratio exceeds 20%, the metal layer is not capable of complying with the deformation of resin, the metal layer is highly likely to crack, and an increase in high frequency resistance is highly likely to occur.

According to the high-frequency electric wire, the wire harness and the manufacturing method thereof, it is possible to provide a high-frequency electric wire, a manufacturing method thereof, and a wire harness in which it is possible to reduce the outer diameter of the electric wire while preventing an increase in high frequency resistance caused by the skin effect, and while reducing costs.

BRIEF DESCRIPTION OF THE DRAWINGS

FIG. 3A illustrates a state of the wire strand before deformation. FIG. 3B illustrates a state of the wire strand after deformation.

FIG. 4A illustrates the high-frequency electric wire. FIG. 4B illustrates the metal-pipe wire rod and a metal wire rod.

FIG. 6A is a graph illustrating the diameter reduction effect.

DETAILED DESCRIPTION

Figure 1:
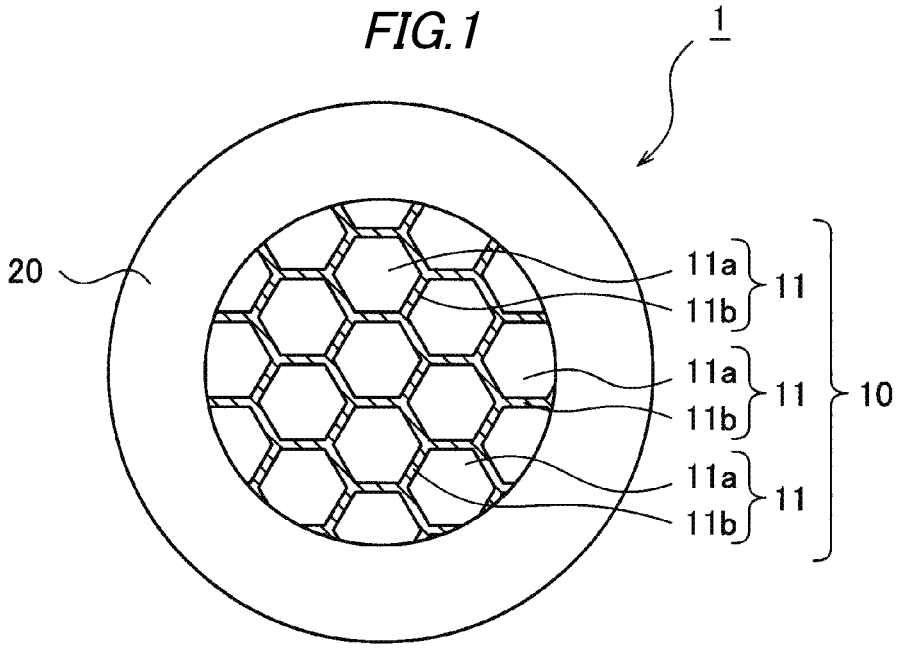
FIG. 1 is a sectional view illustrating an example of a high-frequency electric wire in an embodiment.

An embodiment will be described with reference to the accompanying drawings; however, the present invention is not limited to the embodiment. FIG. 1 is a sectional view illustrating an example of a high-frequency electric wire in the embodiment.

Figure 2:
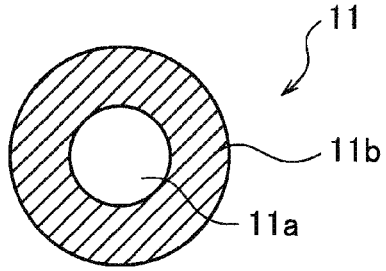
FIG. 2 is a sectional view illustrating a wire strand in FIG. 1.

As illustrated in FIG. 1, a high-frequency electric wire 1 in the embodiment includes a conductor 10, and an insulating sheath 20 with which the insulator 10 is coated. The conductor 10 is obtained by compressing multiple wire strands 11. FIG. 2 is a sectional view illustrating the wire strand in FIG. 1. As illustrated in FIG. 2, the wire strand 11 is obtained by coating the outer circumference of a wire rod 11*a* (which is made of insulating resin) with a metal layer 11*b*. For example, the wire rod 11*a* is made of a polyarylate fiber, and the metal layer 11*b* is made of copper.

Gaps between the wire strands 11 are eliminated by compressing the wire strands 11, resulting in a reduction in the diameter of the high-frequency electric wire 1 in the embodiment. The compression may be performed during bundling of the multiple wire strands 11, or sheathing.

In the high-frequency electric wire 1 according to the embodiment, each of the wire strands 11 of the conductor 10 is compressed in such a way that the deformation ratio of the wire strand 11 exceeds 0% and is 20% or less.

Figure 3A:
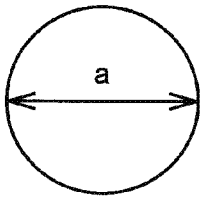
FIGS. 3A and 3B show views illustrating the deformation ratio of the wire strand.
Figure 3B:
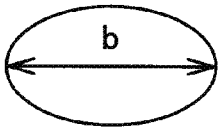

FIGS. 3A and 3B show views illustrating the deformation ratio of the wire strand 11. FIG. 3A illustrates a state of the wire strand 11 before deformation. FIG. 3B illustrates a state of the wire strand 11 after deformation. As illustrated in FIG. 3A, the wire strand 11 before deformation has a substantially perfect circle shaped section, and the diameter of the wire strand 11 is a. In contrast, for example, the wire strand 11 deformed by compression has an elliptical shaped section, and the long diameter of the wire strand 11 is b. In this case, the deformation ratio is $(b-a)/a\times100$. Accordingly, for example, when the long diameter b is equal to 1.1a, the deformation ratio is 10%.

As illustrated in FIG. 3B, when the wire strand 11 is compressed, the sectional shape is not limited to an ellipse, and can be any one of various shapes. For this reason, the long diameter b is used to calculate the deformation ratio in the aforementioned example, the length b is changed according to the sectional shape after compression. For example, when the sectional shape of the wire strand 11 after compression is a polygon, another circular shape, or a combination thereof, the length b used is the longest line segment among line segments connecting two points inside of the polygonal shape or the like.

Figure 4A:
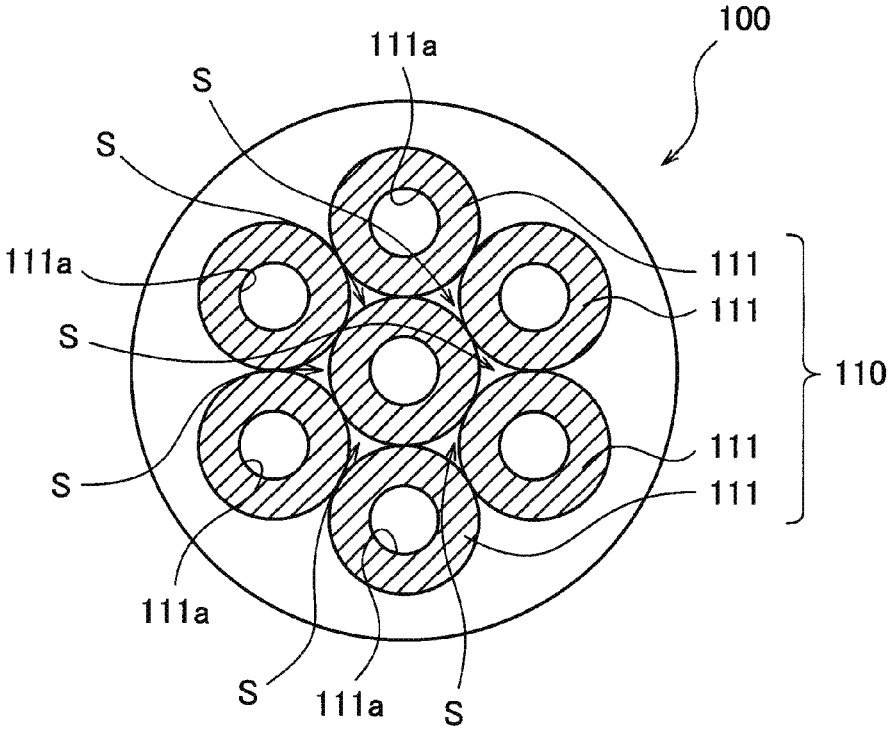
FIGS. 4A and 4B show sectional views illustrating metal-pipe wire rods and a high-frequency electric wire including the metal-pipe wire rods.
Figure 4B:
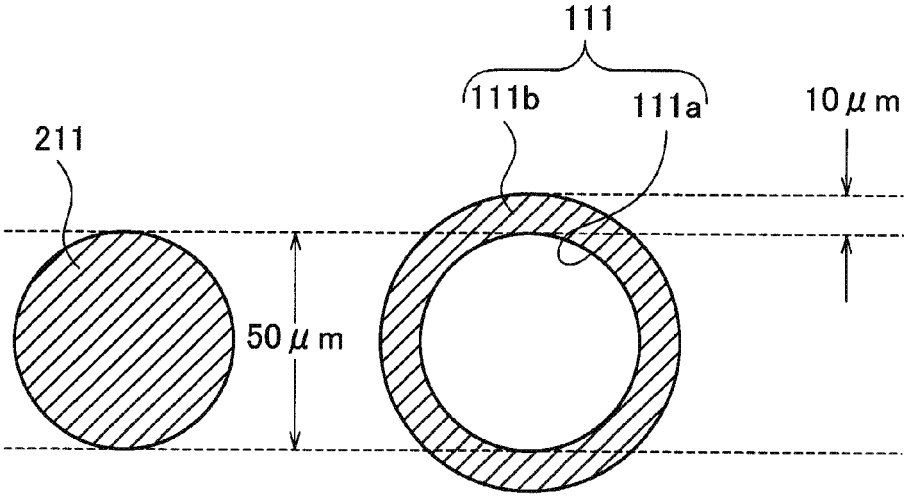

FIGS. 4A and 4B show sectional views illustrating metal-pipe wire rods and a high-frequency electric wire including the metal-pipe wire rods. FIG. 4A illustrates the high-frequency electric wire. FIG. 4B illustrates the metal-pipe wire rod and a metal wire rod. As illustrated in FIG. 4A, in the high-frequency electric wire 100 including metal-pipe wire rods 111, the exterior of each of the metal-pipe wire rods 111 has a circular shaped section, and thus gaps S are formed when the metal-pipe wire rods 111 are laid. When the gaps S are eliminated by compressing a conductor 110 formed of multiple metal-pipe wire rods 111, and the diameter of the high-frequency electric wire 100 is reduced, hollow portions 111*a* of the metal-pipe wire rods 111 are blocked by the compression.

As illustrated in FIG. 4B, for example, in the metal-pipe wire rod 111, a metal portion 111*b* with a thickness of approximately 10 μm is required to be formed on the outside of the hollow portion 111*a* with a diameter of 50 μm so as to transmit high-frequency signals equivalent to a metal wire rod 211 with a diameter of 50 μm. Accordingly, the diameter of the metal-pipe wire rod 111 becomes 70 μm, leading to a hindrance to the reduction in the diameter of a high-frequency electric wire.

However, in the high-frequency electric wire 1 according to the embodiment, each of the wire strands 11 of the conductor 10 is compressed in such a way that the deformation ratio of the wire strand 11 exceeds 0% and is 20% or less. For this reason, it is possible to reduce the diameter of the high-frequency electric wire while reducing costs.

That is, since the wire strand 11 obtained by coating the outer circumference of the wire rod (which is made of insulating resin) 11*a* with the metal layer 11*b* is used, a waste portion through which current does not flow during transmission of high-frequency signals can be made of resin, and thus it is possible to reduce the costs of the wire rod. Since such a wire strand is used, it is possible to compress the conductor 10 formed of the multiple wire strands 11, and to reduce the outer diameter of the electric wire.

Each of the wire strands 11 of the conductor 10 is compressed in such a way that the deformation ratio of the wire strand 11 exceeds 0% and is 20% or less. The reason for this is that when the deformation ratio exceeds 20%, the metal layer 11*b* is not capable of complying with the deformation of resin and the metal layer 11*b* is highly likely to crack.

Figure 5:
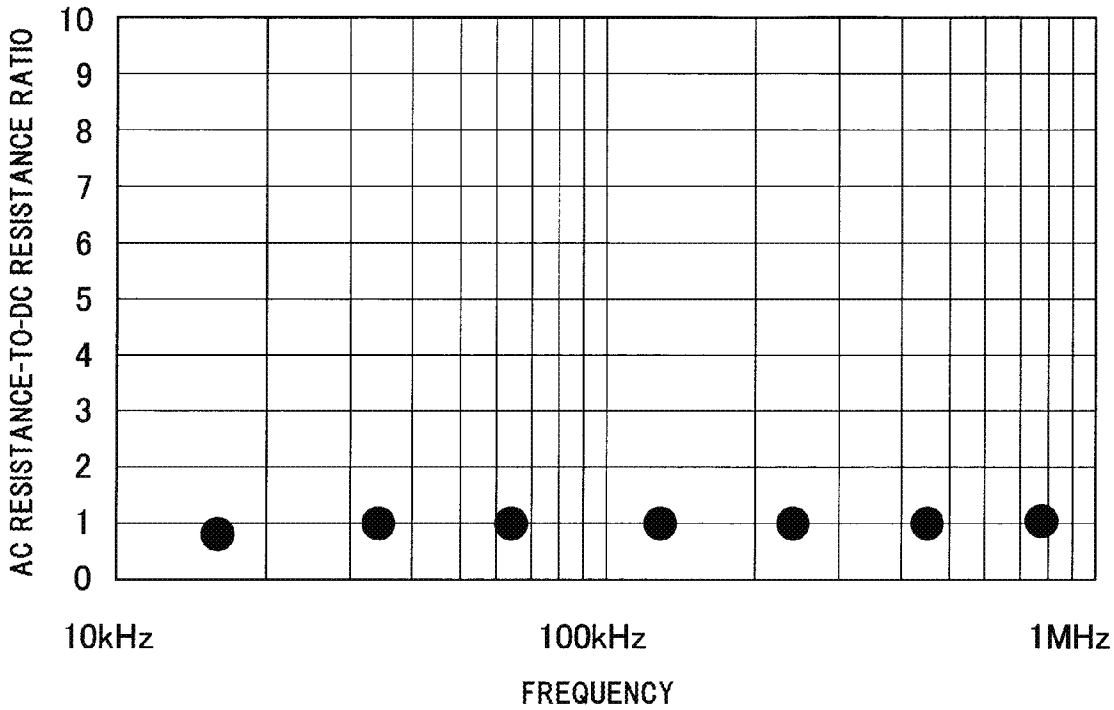
FIG. 5 is a graph illustrating a relationship between the frequency and the resistance of the high-frequency electric wire in the embodiment.

FIG. 5 is a graph illustrating a relationship between the frequency and the resistance of the high-frequency electric wire 1 in the embodiment. In FIG. 5, the vertical axis represents an AC resistance-to-DC resistance ratio, and the horizontal axis represents the frequency. FIG. 5 illustrates the results of testing the high-frequency electric wire 1 in which 80 wire strands 11, each of which is obtained by coating the wire 11*a* (which is made of a polyarylate fiber with a fiber diameter of 22 μm) with the metal layer 11*b* (which is made of copper and having a thickness of approximately 1.5 μm), are bundled, and the deformation ratio of each of the wire strands 11 is 10%.

As illustrated in FIG. 5, the AC resistance-to-the DC resistance ratio is approximately one at approximately 17 kHz, approximately 35 kHz, and approximately 65 kHz. Similarly, the AC resistance-to-the DC resistance ratio is approximately one at approximately 130 kHz, approximately 250 kHz, approximately 450 kHz, and approximately 780 kHz. That is, even though the skin effect occurs during transmission of high-frequency signals, the AC resistance is not increased compared to the DC resistance, transmission loss is said to not occur during transmission of the high-frequency signals.

Figure 6A:
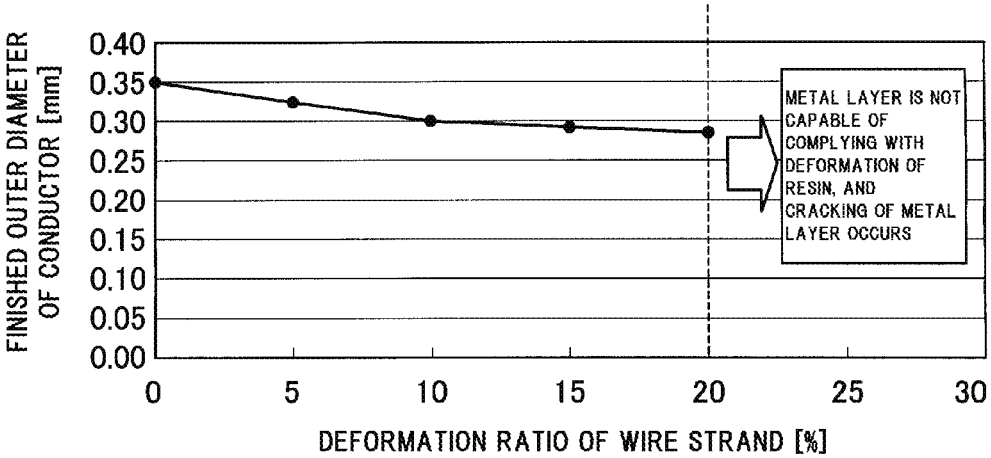
FIG. 6A show views illustrating the diameter reduction effect in the high-frequency electric wire according to the embodiment.
Figure 6B:
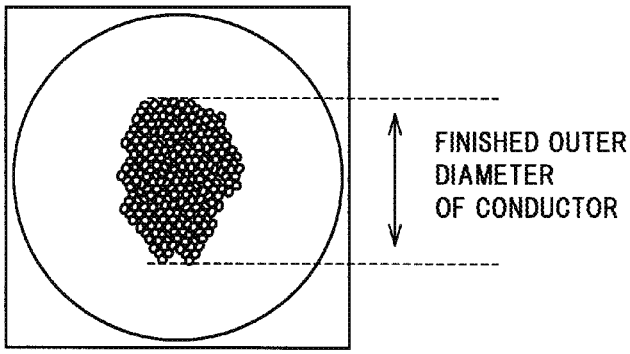
FIG. 6B illustrates the finished diameter of a conductor.

FIGS. 6A and 6B show views illustrating the diameter reduction effect in the high-frequency electric wire 1 according to the embodiment. FIG. 6A is a graph illustrating the diameter reduction effect. FIG. 6B illustrates the finished diameter of the conductor. In FIG. 6A, the vertical axis represents the finished outer diameter of the conductor 10, and the horizontal axis represents the deformation ratio of the wire strand 11. FIGS. 6A and 6B illustrates the test results for changing the deformation ratio of the wire strand 11 in the high-frequency electric wire 1 including the conductor 10 that is obtained by bundling together 80 wire strands 11, each of which is obtained by coating the wire 11*a* (which is made of a polyarylate fiber with a fiber diameter of 22 μm) with the metal layer 11*b* (which is made of copper and having a thickness of approximately 1.5 μm).

As illustrated in FIG. 6A, when the deformation ratio of the wire strand 11 was 0%, the finished outer diameter of the conductor 10 was 0.35 mm. As illustrated in FIG. 6B, the finished outer diameter used was the longest length among line segments connecting two points on the outer circumference of the conductor 10.

When the deformation ratio of the wire strand 11 was 5%, the finished outer diameter of the conductor 10 was 0.32 mm, and when the deformation ratio of the wire strand 11 was 10%, the finished outer diameter of the conductor 10 was 0.30 mm. When the deformation ratio of the wire strand 11 was 15%, the finished outer diameter of the conductor 10 was 0.29 mm, and when the deformation ratio of the wire strand 11 was 20%, the finished outer diameter of the conductor 10 was 0.28 mm.

When the deformation ratio exceeded 20%, the metal layer 11*b* was not capable of complying with the deformation of the wire rod 11*a*, and the cracking of the metal layer 11*b* was confirmed.

As such, it is possible to reduce the finished outer diameter of the conductor 10, and the finished outer diameter of the high-frequency electric wire 1 by increasing the deformation ratio of the wire strand 11.

Hereinafter, a method of manufacturing the high-frequency electric wire 1 in the embodiment will be described. First, the wire strand 11 is manufactured in the manufacturing of the high-frequency electric wire 1 in the embodiment. That is, the wire road 11*a* made of a fiber (for example, a polyarylate fiber) or another insulator is prepared, and the metal layer 11*b* is formed on the outside of the wire rod 11*a*. At this time, an operator immerses the wire rod 11*a* in a metal plating bath such that the metal layer 11*b* is formed on the wire rod 11*a* (first step).

Subsequently, the operator twists and bundles together multiple wire strands 11 obtained such that the multiple wire strands 11 are compressed (second step). Thereafter, the conductor 10 obtained by the compression is sheathed and compressed (second step). Accordingly, the high-frequency electric wire 1 is manufactured.

In the aforementioned steps according to the embodiment, each of the wire strands 11 is compressed in such a way that the deformation ratio of the wire strand 11 exceeds 0% and is 20% or less. That is, the deformation ratio of each of the wire strands 11 exceeding 0% and 20% or less is obtained by the bundling and the sheathing. Accordingly, the diameter of the high-frequency electric wire 1 is reduced.

In the high-frequency electric wire 1 and the manufacturing method thereof according to the embodiment, since the conductor 10 is formed of the multiple wire strands 11, high-frequency signals are transmitted through the surface side of each of the wire strands 11, and thus it is possible to suppress an increase in high frequency resistance caused by the skin effect. Since the wire strand 11 obtained by coating the outer circumference of the wire rod 11*a* (which is made of insulating resin) with the metal layer 11*b* is used, the waste portion through which current does not flow during transmission of high-frequency signals can be made of resin, and thus it is possible to reduce the costs of the wire rod. Since such the wire strand 11 is used, it is possible to compress the conductor 10 formed of the multiple wire strands 11, and to reduce the outer diameter of the electric wire. As a result, it is possible to reduce the outer diameter of the electric wire while preventing an increase in high frequency resistance caused by the skin effect, and while reducing costs.

Each of the wire strands of the conductor is compressed in such a way that the compression ratio of the wire strand exceeds 0% and is 20% or less. The reason for this is that when the deformation ratio exceeds 20%, the metal layer is not capable of complying with the deformation of resin, the metal layer 11*b* is highly likely to crack, and an increase in high frequency resistance is highly likely to occur.

The present invention has been described based on the embodiment; however, the present invention is not limited to the embodiment, and the embodiment may be modified insofar as the modification does not depart from the purport of the present invention. For example, the material of the wire rod 11*a* in the embodiment is not limited to a polyarylate fiber, and the wire rod 11*a* may be made of an aramid fiber, a PBO fiber, another insulator, or the like.

The material of the metal layer 11*b* in the embodiment is not limited to copper, and the metal layer 11*b* may be made of a copper alloy, aluminum, tin, or alloys thereof.

The high-frequency electric wire in the embodiment of the present invention can be used for various purposes, and as an example, is used in a wire harness routed in a vehicle.

The characteristics of the high-frequency electric wire, the manufacturing method thereof, the wire harness in the embodiment are collectively and briefly described in [1] to [3] hereinbelow.

[1]A high-frequency electric wire includes a conductor (10) obtained by compressing multiple wire strands (11), each of which includes a wire rod (11*a*) made of insulating resin and a metal layer (11*b*) with which the outer circumference of the wire rod (11*a*) is coated, and a sheath (20) provided on the conductor (10). Each of the wire strands (11) of the conductor (10) is compressed in such a way that the deformation ratio of the wire strand (11) exceeds 0% and is 20% or less.

[2]A method of manufacturing a high-frequency electric wire (1) includes a first step of obtaining a wire strand (11) by coating the outer circumference of a wire rod (11*a*) made of insulating resin with a metal layer (11*b*), and a second step of compressing multiple wire strands (11) obtained in the first step by bundling and sheathing. In the second step, each of the wire strands (11) is compressed in such a way that the deformation ratio of the wire strand (11) exceeds 0% and is 20%/o or less.

[3]A wire harness uses the high-frequency electric wire (1) described in [1].

The present invention has been described in detail with reference to the specific embodiment, and it is apparent to persons skilled in the art that modifications or corrections can be made to the embodiment in various forms, insofar as the modifications or the corrections do not depart from the spirit and the scope of the present invention.

This application is claimed based on Japanese Patent Application No. 2013-151247, filed on Jul. 22, 2013, the content of which is incorporated herein by reference.

According to effects of the present invention, it is possible to reduce the outer diameter of the electric wire while preventing an increase in high frequency resistance caused by the skin effect, and while reducing costs. The present invention with these effects is effectively applied to a high-frequency electric wire, a manufacturing method thereof, and a wire harness.

REFERENCE SIGNS LIST

1: HIGH-FREQUENCY ELECTRIC WIRE
10: CONDUCTOR
11: WIRE STRAND
11*a*: WIRE ROD
11*b*: METAL LAYER
20: SHEATH

What is claimed is:

1. A high-frequency electric wire comprising:

a conductor in which a plurality of wire strands are compressed, each of the wire strands including a wire rod made of electrically insulating resin and a metal layer coating an outer circumference of the wire rod; and a sheath provided on the conductor, wherein the each of the wire strands of the conductor is compressed so that a deformation ratio of the each of the wire strands exceeds 0% and is 20% or less.

2. A method of manufacturing a high-frequency electric wire comprising:

obtaining a plurality of wire strands, each of the wire strands including a wire rod made of electrically insulating resin and a metal layer coating an outer circumference of the wire rod, by coating an outer circumference of each of the wire rods with the metal layer; and compressing the plurality of wire strands by bundling and sheathing, wherein the each of the wire strands is compressed in such a way that a deformation ratio of the each of the wire strands exceeds 0% and is 20% or less.

3. A wire harness comprising the high-frequency electric wire according to claim 1.

* * * * *